US007353912B2

(12) United States Patent
Reuter et al.

(10) Patent No.: US 7,353,912 B2
(45) Date of Patent: Apr. 8, 2008

(54) ELEVATOR SYSTEM

(75) Inventors: Guenter Reuter, Filderstadt (DE); Wolfgang Meissner, Neuhausen (DE); Helmut Schlecker, Plochingen (DE); Walter Nuebling, Ostfildern (DE); Gerhard Thumm, Filderstadt (DE)

(73) Assignee: ThyssenKrupp Elevator AG, Duesseldorf (DE)

( * ) Notice: Subject to any disclaimer, the term of this patent is extended or adjusted under 35 U.S.C. 154(b) by 0 days.

(21) Appl. No.: 11/124,616

(22) Filed: May 6, 2005

(65) Prior Publication Data

US 2005/0279584 A1 Dec. 22, 2005

Related U.S. Application Data

(63) Continuation of application No. PCT/EP02/12538, filed on Nov. 9, 2002.

(51) Int. Cl.

| | |
|---|---|
| ***B66B 9/00*** | (2006.01) |
| ***B66B 1/32*** | (2006.01) |
| ***B66B 1/18*** | (2006.01) |
| ***B66B 1/34*** | (2006.01) |
| ***B66B 3/00*** | (2006.01) |

(52) U.S. Cl. ..... 187/249; 187/288; 187/382; 187/394

(58) Field of Classification Search ..... 187/249, 187/288, 382

See application file for complete search history.

(56) References Cited

U.S. PATENT DOCUMENTS 1,027,628 A 5/1912 Schwab (Continued)

FOREIGN PATENT DOCUMENTS

DE 199 46 204 3/2001

(Continued)

OTHER PUBLICATIONS

*Patent Abstracts of Japan*, vol. 017, No. 358 (M-1440), "Self-Traveling Elevator Control Device", Publication No. 05051185, Publication Date Mar. 2, 1993.

(Continued)

*Primary Examiner*—Peter M. Cuomo
*Assistant Examiner*—Eric E. Pico
(74) *Attorney, Agent, or Firm*—Lipsitz & McAllister LLC

(57) ABSTRACT

The invention relates to an elevator system with at least one shaft, in which at least two cars can be made to travel along a common traveling path, and also with a shaft information system for determining the positions and speeds of the cars, which is connected to an electrical safety device. In order to develop the elevator system in such a way that a high handling capacity can be achieved with constructionally simple means, while reliably preventing car collisions, it is proposed according to the invention that an emergency stop of at least one car is triggerable independently of the control units by means of the safety device if the distance between a first car and a second car or an end of the traveling path goes below a preselectable critical distance, and that the safety gear of at least one car is triggerable if the distance which this car assumes from the neighboring car or an end of the traveling path goes below a preselected minimum distance, the control units of at least all the cars of one traveling path being connected to one another and altogether forming a group control device.

25 Claims, 3 Drawing Sheets

U.S. PATENT DOCUMENTS

| | | | | | |
|---|---|---|---|---|---|
| 1,805,227 | A | | 5/1931 | Rugg | |
| 1,896,776 | A | | 2/1933 | James | |
| 1,896,777 | A | | 2/1933 | James | |
| 1,911,834 | A | | 5/1933 | Lindquist | |
| 1,976,495 | A | * | 10/1934 | Halfvarson | 187/249 |
| 4,836,336 | A | * | 6/1989 | Schroder | 187/384 |
| 5,135,081 | A | * | 8/1992 | Watt et al. | 187/394 |
| 5,360,085 | A | * | 11/1994 | Yoo et al. | 187/406 |
| 5,419,414 | A | * | 5/1995 | Sakita | 187/391 |
| 5,464,072 | A | | 11/1995 | Müller | |
| 5,663,538 | A | * | 9/1997 | Sakita | 187/382 |
| 5,821,477 | A | | 10/1998 | Gerstenkorn | |
| 5,865,274 | A | * | 2/1999 | Kiji et al. | 187/380 |
| 5,877,462 | A | * | 3/1999 | Chenais | 187/249 |
| 5,925,859 | A | * | 7/1999 | Miller et al. | 187/394 |
| 6,273,217 | B1 | * | 8/2001 | Hikita | 187/388 |
| 6,364,065 | B1 | | 4/2002 | Hikita | |
| 6,364,095 | B1 | * | 4/2002 | Layne et al. | 198/852 |
| 6,554,107 | B2 | * | 4/2003 | Yumura et al. | 187/247 |
| 6,955,245 | B2 | * | 10/2005 | Dunser et al. | 187/382 |
| 7,014,014 | B2 | | 3/2006 | Mueller | |
| 2002/0112922 | A1 | | 8/2002 | Smith | |

FOREIGN PATENT DOCUMENTS

| | | |
|---|---|---|
| EP | 0 595 122 | 5/1994 |
| EP | 0 769 469 | 4/1997 |
| EP | 1 087 237 | 3/2001 |
| EP | 0 753 751 | 5/2001 |
| EP | 1 142 814 | 10/2001 |
| EP | 1 158 310 | 11/2001 |
| FR | 2 698 624 | 6/1994 |
| JP | 07-172716 | 7/1995 |
| WO | 01/79101 | 10/2001 |
| WO | 02/068306 | 9/2002 |

OTHER PUBLICATIONS

Extract from the magazine *lift REPORT*, No. 4, Jul./Aug. 1993, front page, table of contents (p. 3) and p. 42 "Vorstellung einer Schachtkopierung mit neuen Absolutgebern".

* cited by examiner

ELEVATOR SYSTEM

This application is a continuation of international application number PCT/EP02/12538 filed on Nov. 9, 2002.

The present disclosure relates to the subject matter disclosed in international application number PCT/EP2002/012538 of Nov. 9, 2002, which is incorporated herein by reference in its entirety and for all purposes.

BACKGROUND OF THE INVENTION

The invention relates to an elevator system with at least one shaft, in which at least two cars can be made to travel along a common traveling path, the cars respectively comprising a safety gear and the cars respectively having an associated control unit, a drive and a brake, and also with a shaft information system for determining the positions and speeds of the cars, which is connected to an electrical safety device.

In an effort to achieve a high handling capacity with the smallest possible overall volume for elevator systems, it has already been proposed to configure the elevator systems in such a way that at least two cars can be made to travel up and down in a shaft along a common traveling path. Consequently, a large number of persons and/or loads can be transported within a short time in one elevator shaft. However, a number of cars traveling along a common traveling path requires additional precautions to avoid car collisions. For this purpose, it is proposed in EP 0 769 469 A1 to provide each car with an associated control unit which comprises a safety module which controls the accelerating and braking behavior of the car not only when a risk of collision exists but also in normal operation. For this purpose, the positions, speeds and call allocations of the cars respectively to be answered are transmitted via a communication system to the safety module, which calculates the necessary accelerating and braking behavior on the basis of preselected travel curves for each car and decides whether or not a car may stop. Infrared sensors which measure the distances from the neighboring cars located above and below the car may be disposed on each car. In addition, a shaft information system may be used, for example measuring strips which are disposed in the shaft and can be scanned by car sensors in the form of light barriers. The data obtained from these can be used to calculate the speeds and positions of all the cars and transmit them via the communication system to the safety modules of all the cars for controlling their braking behavior. The cars are controlled both in normal operation and in the case of a situation which is critical in terms of safety via the safety modules.

Although a high capacity of the elevator system with avoidance of car collisions can be achieved by means of such a control of the cars, the control is very complex and entails relatively high costs. The complexity of the control also makes it susceptible to faults, moreover.

It is an object of the present invention to develop an elevator system of the type stated at the beginning in such a way that a high handling capacity can be achieved with constructionally simple means, while reliably preventing car collisions.

SUMMARY OF THE INVENTION

This object is achieved in accordance with the invention by an elevator system having the features of patent claim 1.

In accordance with the invention each car has an associated control unit, a drive and a brake. A safety device is used in addition to the control units respectively associated with a car. In normal operation of the elevator system the cars are controllable by the control units independently of the safety device while maintaining a safety distance. The safety device triggers an emergency stop of a car by actuation of its brake if the distance which this car has from a neighboring car or an end of a traveling path goes below a preselectable critical distance. The critical distance may be preselected in such a way that it ensures the braking distance required in the case of an emergency stop for stopping the car to avoid a car collision. If the safety device establishes by comparison of the actually existing distance with the critical distance that the actual distance is below the critical distance, and consequently the risk of a car collision exists, the safety device triggers an emergency stop of the car.

The invention also incorporates the idea that it should also be ensured that a car collision is reliably ruled out in the event of a fault of the safety device or in the event of inadequate braking after triggering an emergency stop. For this purpose, it is provided according to the invention that the safety gear of the car is triggered if the distance which this car assumes from the neighboring car or from the end of the traveling path goes below a preselected minimum distance. The minimum distance is in this case chosen to be smaller than the critical distance mentioned above, but it is in any event dimensioned such that it provides the braking distance resulting from triggering of the safety gear without a car collision occurring. It is thus ensured that, even in the event of a fault of the safety device, if a car continues to approach a neighboring car or an end of the traveling path and as it does so goes below the minimum distance, the safety gear is triggered and consequently a car collision is avoided.

A further gain in safety is achieved in the case of the elevator system according to the invention by the control units of at least all the cars of one traveling path being connected to one another and altogether forming a group control device. The movements of all the cars moving along a common traveling path can be monitored by means of the group control device. The group control device comprises the control units respectively associated with a car, which are connected in a wire-bound or wireless manner to one another and, by their interaction, control all the cars. This makes it possible to dispense with a higher-level central unit for the cars of one traveling path. The control units are preferably connected to one another via a BUS system. Alternatively, separate connecting lines may be used. A connection via light guides may also be provided, or the connection may be wireless, for example by radio or light. The elimination of a higher-level central unit allows the elevator system to be made particularly immune to faults, since the failure of an individual control unit merely has the consequence that the car associated with this control unit can no longer be used, but the operation of the remaining cars remains uninfluenced by this.

It is of advantage if the critical distance is dependent on the speed and/or the traveling direction. As a result, the braking behavior dependent on the speed of the car can be taken into account for dimensioning the critical distance, so that a greater critical distance can be preselected in the case of a high speed than in the case of a low traveling speed. This provides the possibility of bringing the cars very close to each other while traveling slowly, for example on the occasion of an inspection or servicing, without an emergency stop being triggered, while a comparatively great critical distance is preselected for traveling at nominal speed. The dependence of the critical distance on the traveling direction makes it possible to take into account the influence of the latter on the braking distance of the car respectively required.

The positions of specific locations within the shaft, including the positions of the upper and lower ends of the traveling path, can preferably also be preselected for the safety device, and an emergency stop can be triggered by means of the safety device if the distance which a car has from the preselected shaft location goes below the critical distance.

It is particularly advantageous if the critical distance is also dependent on the speed, and preferably also the traveling direction, of the second car, which the first car is approaching. It is then possible, for example, to choose the critical distance to be smaller when two cars are traveling one behind the other in the same direction than in the case where they are traveling toward each other.

In the case of a preferred embodiment, it is provided that the control units of cars disposed on different traveling paths are connected to one another and form a group control device. This makes it possible to register the movements of a large number of cars to achieve as high a handling capacity as possible. The control units of all the cars of the entire elevator system are preferably connected to one another and form a group control device, so that the movements of all the cars can be coordinated.

It is of advantage if the control units are connected to the shaft information system, for controlling the respectively associated car while maintaining a speed-dependent and preferably also traveling-direction-dependent distance which the car assumes from the neighboring cars or from an end of the traveling path and also advantageously from a preselected shaft location. A configuration of this type ensures a particularly high handling capacity, since the positions and speeds of all the cars of at least one traveling path can be input via the shaft information system into all the control units, that is the group control device, so that the distances of the cars can be calculated and compared with a speed-dependent safety distance by means of the control units. If the distance goes below the safety distance, which can be chosen to be greater than the critical distance provided for the triggering of an emergency stop, the speed of at least one car can be changed by means of the control units, and the safety distance can be reestablished as a result. The control units consequently not only undertake the function of optimally activating the associated cars for achieving a high handling capacity, they also already represent a first safety stage in such a way that the respectively occurring distances from the neighboring cars and from preselected shaft locations, in particular from the end of the traveling path, are monitored and, if appropriate, the movements of the cars are controlled to maintain the safety distances.

By means of the control units, the drive of the respectively associated car can preferably be switched off and its brake activated. The control units can consequently act directly on the brakes, in order to be able to brake the cars to the extent that the speed-dependent and preferably also traveling-direction-dependent safety distances are maintained. If two cars approach each other in an inadmissible way, one drive or both drives, depending on the traveling direction, may be switched off and the cars braked. For instance, in the case of traveling directions that are opposed to each other, both drives may be switched off and both brakes activated, while in the case of travel in a common direction only the drive of the rear car in the traveling direction is switched off and its brake activated.

For further improvement of the handling capacity of the elevator system, it is advantageous if the elevator system comprises destination input units which are disposed outside the cars and are connected to the control units, for the input of the travel destination. A user of the elevator system can preselect the travel destination desired by him outside the car for all the control units, that is the group control device. Then, taking into account the required safety distances, said group control device chooses the most advantageous car as regards an optimum handling capacity, which transports the user in as short a time as possible to the desired travel destination, it being intended for as few intermediate stops as possible to occur. Other criteria may also be used for the selection of the most advantageous car, for example the energy consumption or the most uniform possible running performance of the individual cars or other components which are associated with the cars.

It is advantageous if the destination input units comprise an indicating device for indicating a car to be used. As a result, the car to be used by him can be indicated to the user on the destination input device.

It is of particular advantage if the safety device comprises a number of safety units respectively associated with a car. In this respect it may be provided in particular that the respective safety unit is disposed on the car. The safety units may be in connection with one another in a wire-bound or wireless manner, for example via light guides, via a BUS system or else by means of radio. Such a configuration makes the safety device particularly immune to faults, since the failure of one safety unit merely has the consequence that the car associated with this safety unit can no longer be used, but the monitoring of the remaining cars, and consequently the overall operation of the elevator system, is not influenced as a result.

In the case of an advantageous embodiment it is provided that the safety device comprises at least one distance determining unit for determining the distance which a car assumes from a neighboring car or an end of the traveling path and preferably also from a preselected shaft location, the distance being determinable by means of the positions of the cars. In the case of an embodiment of this type, the distances are automatically calculated from the positions which are provided by the shaft information system. For this purpose, the positions of neighboring cars can be input into the distance determining units. Furthermore, it may be provided that the positions of specific shaft locations, in particular the positions of the upper and lower ends of the traveling path, can be preselected for the distance determining units. For this purpose, the distance determining units may comprise programmable memory units in which the positions of the shaft locations can be stored.

As an alternative or in addition, it may be provided that the elevator system comprises distance sensors for determining the distance which a specific car assumes from a neighboring car or an end of the traveling path and preferably also from a preselected shaft location, the distance sensors being connected to the safety device. The distance sensors make a direct determination of the distances possible, without the aforementioned positions having to be used for this purpose.

The distance sensors are preferably disposed on the cars, for example in the region of their floor and their ceiling.

Infrared sensors, ultrasound sensors or laser sensors may be used, for example, as distance sensors.

In the case of a particularly preferred embodiment of the elevator system according to the invention, the safety device comprises a determining unit for determining the preferably speed-dependent, and preferably also traveling-direction-dependent, critical distance. As mentioned at the beginning, an emergency stop can be triggered by means of the safety device if the actually existing distance which the car assumes from a neighboring car or from an end of the traveling path goes below the critical distance. In the case of the preferred embodiment, a determining unit is used for determining this critical distance. This unit may for example be given the form of a memory unit for storing speed-dependent and preferably also traveling-direction-dependent critical distance values. Then the traveling direction and the speed of the respectively associated car, and preferably also at least of the directly neighboring car, can be input into the memory unit, so that a critical distance value corresponding to the respective speed and the respective traveling direction can be called up.

As an alternative, it may be provided that the determining unit calculates the critical distance value corresponding to a specific speed and preferably a specific traveling direction on the basis of preselected characteristic data of the elevator system.

It is of advantage if the safety device comprises a comparison unit for comparison of the real, that is actually existing, distance between a car and a neighboring car or an end of the traveling path with the preselectable critical distance, preferably dependent on the speed and, if appropriate, the traveling direction, and for providing an emergency stop signal if the actual distance goes below the critical distance.

The comparison unit is preferably in connection with a downstream brake control, into which the emergency stop signal provided by the comparison unit can be input and which then outputs a control signal activating the brake.

The elevator system preferably comprises at least one speed ascertaining unit for ascertaining the speed of the cars. It is advantageous in this respect if each car has an associated separate speed ascertaining unit. In particular, it may be provided that the respectively associated speed ascertaining unit is disposed on the car.

As an alternative, it may be provided that the speed ascertaining unit is integrated into the safety device and is coupled to the car via a wire-bound or wireless connection.

In the case of a constructionally particularly simple configuration of the elevator system, which is also distinguished by particularly high immunity to faults, it is provided that the shaft information system comprises a marking system disposed in the shaft and/or on the cars, with a multiplicity of markings which can be read by readers disposed on the cars or in the shaft, the readers being coupled to the safety device.

The marking system is preferably disposed within the shaft, and a reader for reading the markings is located on each car.

The reading process may be performed contactlessly, in particular a magnetic and/or optical reading of the markings of the marking system may be provided.

The readers may provide the safety device with an electrical signal, which represents the position and preferably also the speed and the direction of movement of the car in coded form. Within the safety device, a decoding of this signal may be performed by means of a decoder unit for the further processing of position, traveling-direction and/or speed data of the car.

The marking system may comprise, for example, barcode symbols disposed on a carrier, and the readers may be configured as barcode readers. In this case, the barcode readers may be configured as laser scanners.

A barcode disposed on a carrier can be optically read by means of the barcode readers. The barcode in this case represents the current position, and the change in the position data per unit of time represents a measure of the speed of the car on which the barcode reader is mounted. The direction of movement of the car may be obtained from the successively following position data. The barcode reader provides the safety device and the control unit of the car with an electrical signal, which contains all the information for determining the position, the traveling direction and the speed of the respectively associated car. To ensure trouble-free operation, it may also be provided that a first barcode reader is connected to the safety device and a second barcode reader is connected to the control unit.

As mentioned at the beginning, the triggering of at least one safety gear is provided according to the invention in addition to the triggering an emergency stop in the event that two cars approach each other in an inadmissible way. In the case of a preferred embodiment, the safety gear can be mechanically triggered.

In this respect it is advantageous if each car has an associated element, projecting in the direction of a neighboring car, and also a stop element for triggering a safety gear, at least one projecting element being adapted to act upon a stop element for triggering a safety gear if the distance between two neighboring cars goes below the minimum distance. The distance of the projecting element from the associated car and the positioning of the stop element on the car are chosen in such a way that the projecting element of one car strikes the stop element of the other car if the distance between the two cars corresponds to the preselected minimum distance. This is chosen such that the car is reliably brought to a standstill within the minimum distance after the triggering of the safety gear.

It may thus be provided that the safety gear of the first car can be triggered by the projecting element associated with this car striking against the stop element of the neighboring second car. For this purpose, the projecting element of the first car is in operative connection with the safety gear of said car. If, for example, the first car is moving in the direction of a stationary second car, the projecting element of the first car strikes against the stop element of the stationary car when the distance goes below the minimum distance, and this has the consequence that the safety gear of the moving car is triggered and said car is abruptly braked and brought to a standstill. As a result, further approach of the first car to the second car is reliably avoided.

It may also be provided that the safety gear of the second car can be triggered by the projecting element associated with the first car striking against the stop element of the second car. In this case, the stop element of the second car is in operative connection with the safety gear of said car. If, for example, a car approaches a stationary car in an inadmissible way, the projecting element of the stationary car strikes against the stop element of the moving car, whereby the safety gear of the latter car is triggered, so that it comes to a stop after a short braking distance.

It is advantageous if the distance of the projecting element from the associated car is variable, since this allows the distance to be adapted to the respectively provided operating conditions of the car, in particular to its nominal speed.

It may be provided that the projecting element is connected to the associated car via rigid connecting elements. For this purpose, in the case of an embodiment which can be produced at particularly low cost, it may be provided that the projecting element is connected to the associated car via a rod.

The projecting element is advantageously formed as an elongate actuating element.

The cars usually have in each case an associated co-running speed governor cable, which is coupled to the respective safety gear—preferably via a safety linkage. In this respect, it is of advantage if the projecting element is mounted on the speed governor cable. For this purpose, a collar or sleeve which is fixed at the preselected distance to the car on its speed governor cable and interacts with the stop element of the neighboring car in the event of an inadmissible approach, may be provided, for example.

The projecting element is preferably fastened displaceably on the speed governor cable. This provides the possibility of preselecting different distances by displacement, for example sliding, of the projecting element.

In order, for example, to ensure that two cars can be deliberately positioned at a small distance from each other in the event of inspection travel or servicing, it is provided in the case of a particularly preferred embodiment of the elevator system according to the invention that the stop element can be moved back and forth between a stop position, in which the projecting element of the neighboring car can strike against the stop element, and a release position, in which the projecting element of the neighboring car can pass the stop element. This provides the possibility of transferring the stop element of one car into its release position when it is intentionally made to approach the neighboring car, so that the projecting element of the other car can pass the stop element of the one car. This consequently prevents a safety gear from being triggered when the two cars are deliberately brought very close to each other.

For this purpose, the stop element may be movably disposed on the car, for example such that it can pivot or slide. As an alternative or in addition, it may be provided that the stop element is of a multi-part configuration, two parts being able to swing apart, so that the projecting element of the other car can be moved between the two parts of the stop element.

As an alternative and/or in addition to the mechanical triggering of the safety gear, in the case of a particularly preferred embodiment of the elevator system according to the invention it is provided that the safety gear can be triggered by means of the safety device. In this case, in addition to its function of triggering an emergency stop when the distance goes below a critical distance, the safety device undertakes the further function of triggering the safety gear of at least one car if the distance goes below a further distance, that is the minimum distance.

In this respect it is advantageous if the safety device comprises a determining unit for determining a speed-dependent and advantageously also traveling-direction-dependent minimum distance. A configuration of this type has the advantage that, when two cars slowly approach each other, a smaller minimum distance can be used for triggering a safety gear than when the cars approach each other quickly. In particular, it may be provided that, on the occasion of inspection or servicing travel, with very low speed of the cars, the minimum distance can be preselected by the determining unit to the value 0, so that two cars can come right up against each other without a safety gear being triggered. The minimum distance required for triggering a safety gear can consequently be electronically monitored by means of the determining unit.

The determining unit may for example be given the form of a memory unit, in which a multiplicity of speed-dependent and preferably also traveling-direction-dependent minimum distance values are stored, so that, depending on the respectively applicable speed and the respectively applicable traveling direction, the associated minimum distance value can be called up.

As an alternative, it may be provided that the minimum distance value can be calculated by means of the determining unit.

The comparison of the actually existing distance with the minimum distance is preferably performed by means of a comparison unit of the safety device, which provides a safety gear trigger signal if the actual distance goes below the minimum distance.

The following description of preferred embodiments of the invention serves for further explanation in conjunction with the drawings.

DETAILED DESCRIPTION OF THE INVENTION

Figure 1:
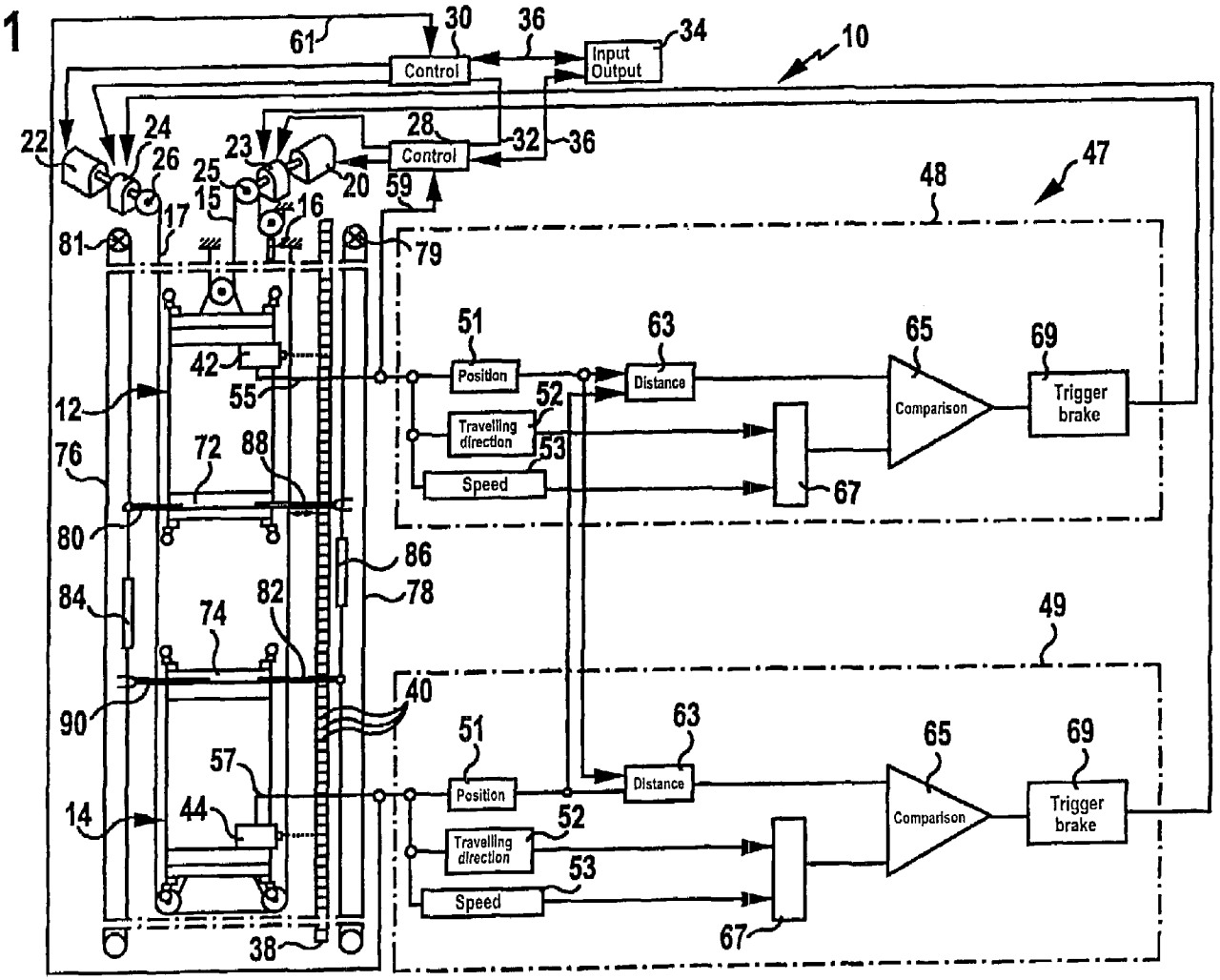
FIG. 1 shows a schematic representation of a first embodiment of an elevator system according to the invention.

In FIG. 1, a first embodiment of an elevator system according to the invention is represented in a greatly schematized form and provided overall with the reference numeral 10. The elevator system 10 comprises two cars 12, 14, which are disposed one above the other in a shaft (not represented in the drawing) and can be made to move up and down along a common traveling path, which is known per se and therefore not represented in the drawing. The car 12 is coupled to a counterweight 16 via a suspension cable 15. The car 14 is held on a suspension cable 17, which interacts in a way corresponding to the suspension cable 15 with a counterweight, which however is not represented in the drawing, in order to achieve a better overview.

Each car 12, 14 has an associated separate drive in the form of an electric drive motor 20 and 22, respectively, and in each case a separate brake 23 and 24, respectively. The drive motors 20, 22 in each case have an associated traction sheave 25 and 26, respectively, over which the suspension cables 15 and 17 are led.

The guidance of the cars 12, 14 in the vertical direction along the common traveling path is performed by means of guide rails that are known per se and therefore not represented in the drawing.

Each car 12, 14 has an associated separate control unit 28 and 30, respectively, for controlling the cars 12, 14. The control units 28, 30 are in electrical connection via control lines with the respectively associated drive motor 20 and 22 and also with the associated brake 23 and 24, respectively. In addition, the control units 28, 30 are directly connected to one another via a connecting line 32. By means of the drive motors 20, 22 and control units 28, 30, the cars 12 and 14 can be made to travel in a customary way within the elevator shaft for the transportation of persons and/or loads.

The elevator system 10 comprises destination input units 34, which are disposed outside the cars 12, 14 on each floor to be served and with which the desired destination can be input by the user. To achieve a better overview, only one destination input unit 34 is schematically shown in FIG. 1.

They not only serve for the input of a travel destination, they also additionally have an indicating unit that is known per se and therefore not represented in the drawing, for example a screen, with which a car selected for use by the control units 28, 30 can be indicated to the user. The destination input units 34 are in electrical connection with the control units 28 and 30 via bidirectional transmission lines 36. They may be configured for example as touch-sensitive screens in the form of so-called touch screens, which make simple input of the travel destination and simple indication of the car to be used possible.

The control units 28, 30 respectively associated with a car 12, 14 altogether form an electronic group control device of the elevator system 10, each control unit 28, 30 within the group being able to control independently the associated car 12 or 14. In connection with a destination input provided by the users via the destination input units 34 disposed outside the cars, the group control can perform a very rapid car assignment and carry out optimized travel control, and so achieve a very high handling capacity extremely safely.

The elevator system 10 has a shaft information system in the form of a barcode carrier 38, which extends along the entire traveling path and carries barcode symbols 40, which can be optically read by barcode readers 42 and 44 respectively disposed on a car 12, 14. The barcode symbols 40 represent a position indication in coded form and are read by the barcode readers 42 and 44. The position indications that are consequently registered contactlessly are output as electrical signals by the barcode readers 42 and 44.

If the cars 12 or 14 move within the shaft, the respective position of the cars 12, 14 is registered by means of the associated barcode readers 42 and 44. Furthermore, the speeds of the cars 12, 14 can be ascertained from the change in the position data per unit of time. In addition, the scanning of the barcode symbols 40 makes it possible to ascertain the traveling direction of the cars 12 and 14 from the successive position indications.

The elevator system 10 comprises a safety device 47, which has a number of safety units 48, 49 which are respectively associated with a car 12 or 14 and correspond in their number to the number of cars 12, 14 being used. The safety units 48 and 49 are identically constructed and in each case comprise a position evaluating unit 51, a traveling-direction evaluating unit 52 and a speed evaluating unit 53. The position, traveling-direction and speed evaluating units 51, 52, 53 of the safety unit 48 are in electrical connection with the barcode reader 42 of the car 12 via a data line 55, and the position, traveling-direction and speed evaluating units 51, 52 and 53 of the safety unit 49 are connected to the barcode reader 44 of the car 14 via a corresponding data line 57. Said evaluating units 51, 52 and 53 process the electrical signal provided by the associated barcode reader 42 and 44, respectively, to provide a position, traveling-direction or speed signal. The control units 28 and 30 also have corresponding position, traveling-direction and speed evaluating units, which are connected to the data lines 55 and 57 via input lines 59 and 61, respectively. Consequently, the information provided by the barcode readers 42 and 44 concerning the position, the traveling direction and the speed of the respective cars 12 and 14, respectively, is available not only to the safety device 47, but additionally also to the respectively associated control units 28 and 30.

The safety units 48 and 49 have in each case a distance determining unit 63, which is in electrical connection with the position evaluating units 51 of the two safety units 48 and 49 and calculates from the position signals of the two position evaluating units 51 the real distance which the two cars 12 and 14 have from each other. An electrical signal corresponding to the real distance is then passed on from the distance determining unit 63 to a comparison unit 65 of the safety units 48 and 49. The comparison units 65 have two inputs. Present at a first input is the electrical signal of the distance determining unit 63, corresponding to the real distance between the two cars 12, 14. A second input of the comparison unit 65 is connected to a determining unit 67, which is connected on the input side to the outputs of the traveling-direction evaluating unit 52 and of the speed evaluating unit 53. The determining unit 67 is configured as a read-write memory. During a programming phase, speed-dependent and traveling-direction-dependent critical distance values are input into the determining unit 67 and can be called up during the traveling operation of the elevator system 10. During travel, the speed and traveling-direction signals can be fed to the determining unit 67, so that the preselected critical distance corresponding to these input data can be called up and passed on to the comparison unit 65.

The critical distance corresponding to the traveling direction and the speed of the respective car 12 or 14 is compared in the comparison unit 65 with the real distance which the respectively associated car assumes from the neighboring car. If the real distance goes below the critical distance, an emergency stop signal is output by the comparison unit 65 and causes a brake control unit 69, connected downstream of the comparison unit 65, to output an electrical signal activating the brake 23 or 24 associated with the respective car 12, 14.

As already mentioned, the electrical signals provided by the barcode readers 42 and 44 are also transmitted via the input lines 59 and 61 to the control units 28 and 30, which altogether form a group control device. This makes it possible during the normal operation of the elevator system 10 to control the cars 12 and 14 by means of the control units 28, 30 while maintaining a safety distance.

Should a fault of the control units 28, 30 and of the safety device 47 occur, or should the braking of the cars 12 and/or 14 not be adequate after triggering of an emergency stop, and the cars 12 and 14 continue to approach each other, the traveling of the cars 12 and/or 14 is braked by mechanical means in a further safety stage. For this purpose, each car comprises a safety gear 72 and 74, respectively, which is known per se and therefore only schematically represented in the drawing, and a speed governor cable 76 and 78, respectively. In a way which is customary and therefore only represented very schematically in the drawing, the latter are led over deflection pulleys disposed at the lower end of the elevator shaft and over speed governors 79, 81 disposed at the upper end of the elevator shaft, and are in each case fixed to a safety gear linkage 80 and 82, respectively, of the associated car 12, 14. If a maximum speed of the cars 12, 14 is exceeded, the speed governors 79, 81 can trigger the safety gear 72 and 74, respectively, via the speed governor cables 76 and 78 and the respective safety gear linkages 80 and 82.

Mounted on the speed governor cables 76 and 78 at a preselected distance from the respective car 12 or 14 there is in each case an element projecting in the direction of the neighboring car in the form of an actuating sleeve 84 or 86, which has on the other car, respectively, an associated stop element in the form of a pivot arm 88 or 90, coupled to the respective safety gear 72 or 74. The actuating sleeve 84, coupled to the car 12 via the speed governor cable 76, projects in the direction of the car 14 beyond the lower end of the car 12 facing the car 14. In a corresponding way, the actuating sleeve 86 coupled to the car 14 via the speed governor cable 78 projects in the direction of the car 12 beyond the upper end of the car 14 facing the car 12.

Should the cars 12 and 14 continue to come closer together in an inadmissible way, for example in the event of a fault of the safety device 47 or else in the event of inadequate braking of the cars 12 and/or 14 after an emergency stop, the actuating sleeves 84 and 86 come up against the pivot arms 90 and 88, respectively, projecting laterally beyond the cars 12, 14. The striking of the actuating sleeves 84 and 86 against the respectively associated pivot arms 88 and 90 has the consequence that an actuating force is exerted on the safety gears 72 and 74, respectively, and the latter are triggered. This has the effect that the cars 12 and 14 are abruptly braked in the customary way and come to a standstill within a very short distance. A collision of the two cars 12 and 14 is consequently reliably prevented by mechanical means.

The pivot arms 88 and 90 coupled to the respective safety gear 72 or 74 are mounted on the respective car 12 or 14 in such a way that they can slide in the horizontal direction. This provides the possibility of moving them back and forth between a stop position, represented in FIG. 1, and a release position, in which the free end of the pivot arms 88 and 90 is in each case disposed at a distance from the associated speed governor cable 78 and 76, respectively. If the pivot arms 88 and 90 are moved into their release position, this has the consequence that the actuating sleeves 88 and 86 do not come up against the associated pivot arms 88 and 90, and the safety gears cannot be triggered, even if the two cars 12 and 14 are brought very close to each other. This provides the possibility of making the two cars 12 and 14 approach each other at low speed, for example, on the occasion of inspection or servicing travel, the determining unit 67 of the safety units 47 and 49 providing a very small critical distance value, below which the distance between the two cars does not go even when they are brought very close to each other. The triggering of an emergency stop is consequently avoided, just as the triggering of a safety gear is avoided. It may be possible that the information concerning the desired low traveling speed can be output from the control unit 28, 30 to the determining unit 67.

Figure 2:
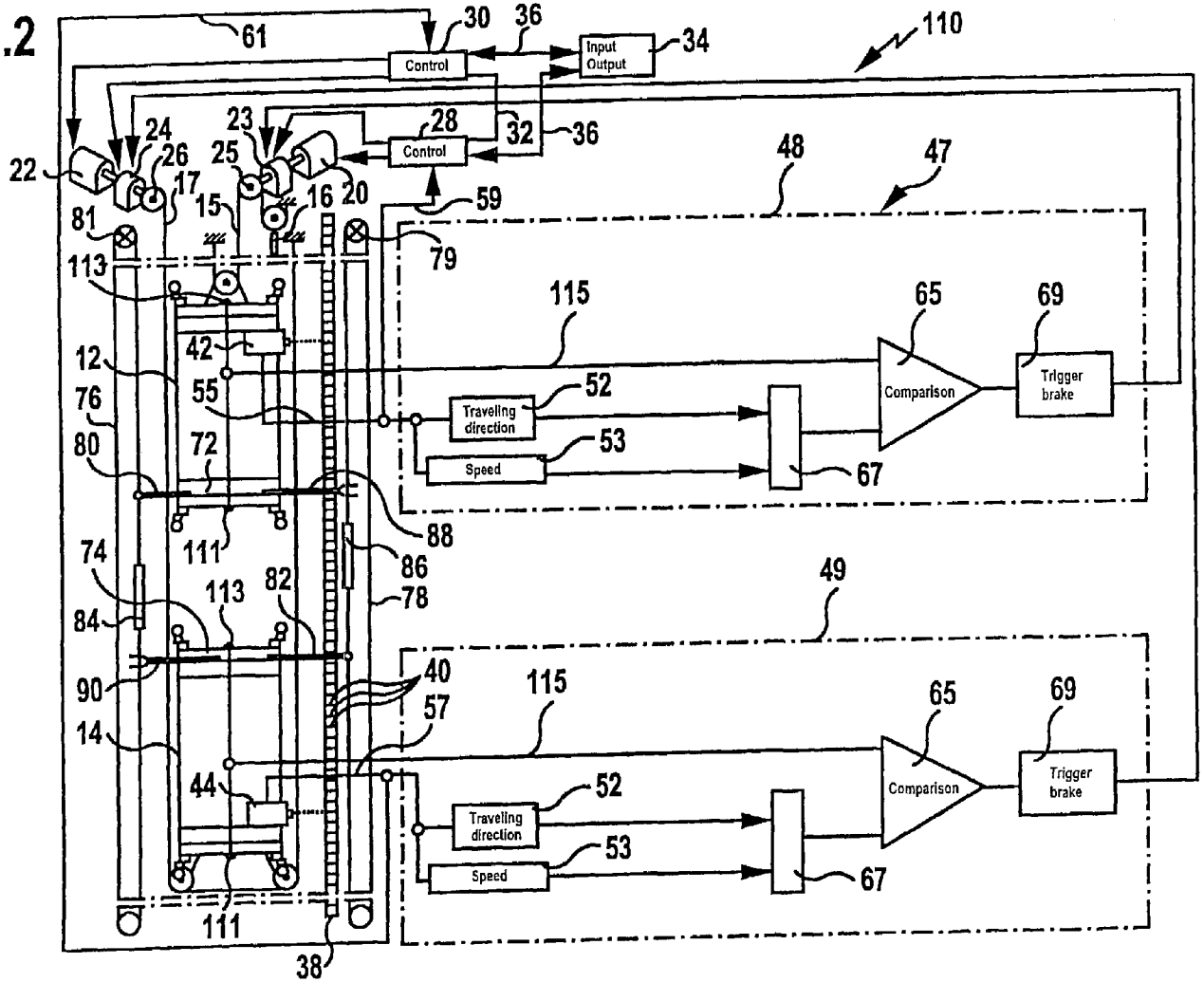
FIG. 2 shows a schematic representation of a second embodiment of an elevator system according to the invention.

A second embodiment of an elevator system according to the invention is represented in a greatly schematized form in FIG. 2 and provided overall with the reference numeral 110. The elevator system 110 is constructed largely identically to the elevator system 10 explained above with reference to FIG. 1. Identical components are therefore designated by the same reference numerals as in FIG. 1 and reference is made to the full content of the above with regard to the construction and function of the components.

The elevator system 110 differs from the elevator system 10 only in that the real distance which the two cars 12, 14 assume from each other is not ascertained electronically by means of a distance determining unit on the basis of the information provided by the barcode readers 42 and 44, but instead the distance between them is registered independently of the barcode readers 42 and 44 by contactless distance sensors 111 and 113 disposed on the upper side and underside of the cars 12 and 14. The distance sensors 111 and 113 of each car 12 and 14 are connected to the comparison unit 65 of the associated safety units 48 and 49, respectively, via a separate data line 115. The information provided by the barcode readers 42 and 44 is used for determining the traveling direction and the speed of the respective car 12, 14, while the distance determination is performed independently of that with the aid of the distance sensors 111 and 113. It is consequently possible to dispense with a position evaluating unit 51 in the case of the safety units 48 and 49 of the elevator system 110. Once again, the real distance which the two cars 12, 14 have from each other is compared with a critical distance, which is dependent on the traveling direction and speed of the respectively associated car 12 or 14. If appropriate, an emergency stop is triggered by the safety unit 48 or 49, as already explained above. Should the braking of the cars 12 and/or 14 brought about by this not be adequate for the reliable prevention of a collision, at least one safety gear is triggered by mechanical means, as explained above with reference to FIG. 1, also in the case of the elevator system 110 represented in FIG. 2.

The distance sensors 111, 113 may also be used for the purpose of ascertaining the respective distance from the lower or upper end of the traveling path.

Figure 3:
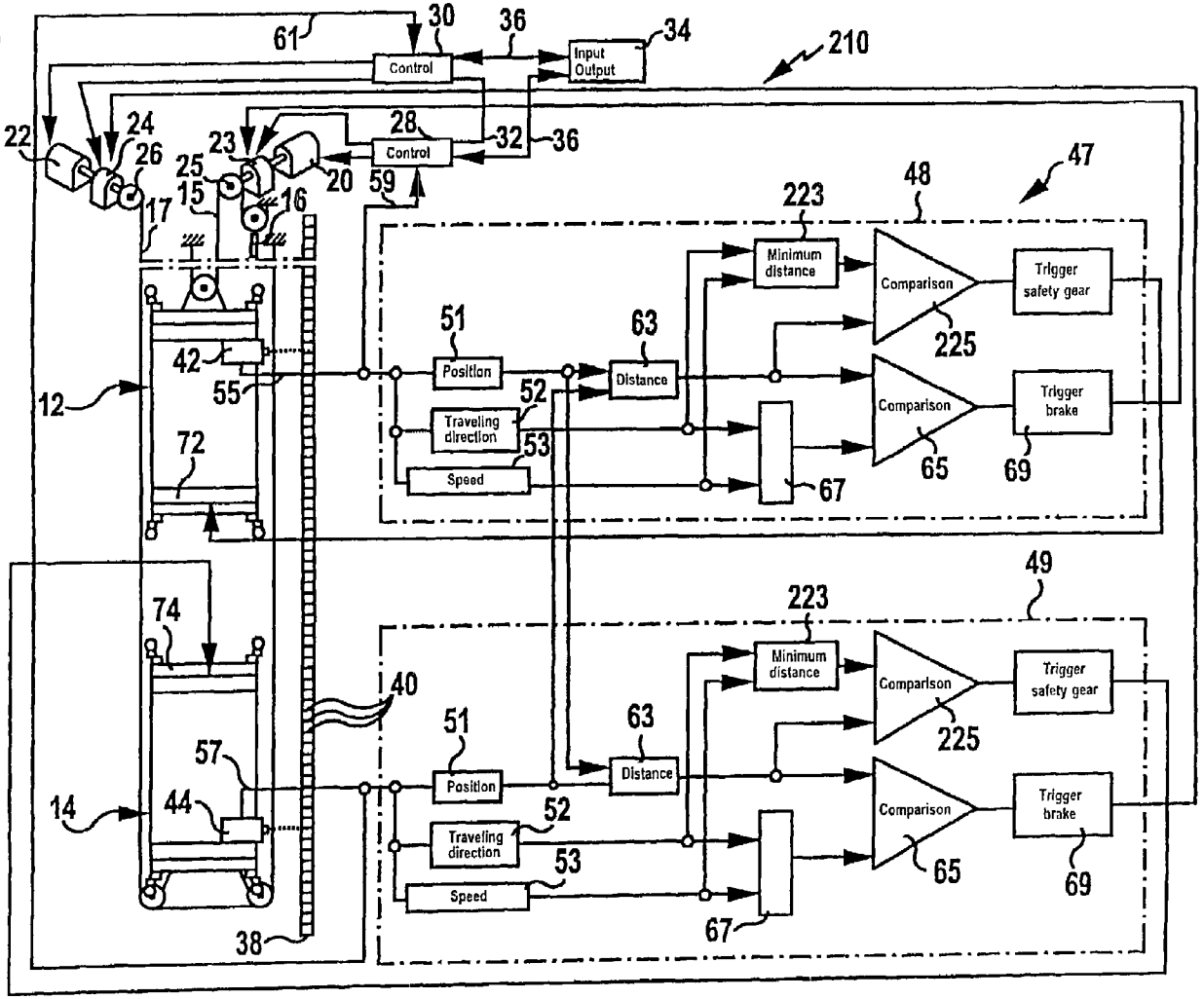
FIG. 3 shows a schematic representation of a third embodiment of an elevator system according to the invention.

In FIG. 3, a third embodiment of the elevator system according to the invention is represented and provided overall with the reference numeral 210. This is once again constructed largely identically to the elevator system 10 explained above with reference to FIG. 1. Identical components are therefore also designated by the same reference numerals as in FIG. 1 in the case of the embodiment represented in FIG. 3 and reference is likewise made to the full content of the above with regard to the construction and function of the components.

The elevator system 210 represented in FIG. 3 differs from the elevator system 10 only in that the triggering of the safety gears 72 and 74, respectively, of the cars 12 and 14 is not performed mechanically by means of actuating sleeves and associated pivot arms fixed to speed governor cables, but instead the safety gears 72 and 74 are electronically triggered by the respectively associated safety units 48 and 49 if the two cars 12 and 14 approach each other in an inadmissible way. For this purpose, the safety units 48 and 49 comprise in addition to the determining unit 67 a further determining unit 223, with the aid of which a minimum distance dependent on the moving direction and the speed of the respectively associated car 12 or 14 can be determined and can be compared in an additional comparison unit 225 with the distance really existing between the two cars 12 and 14. The traveling-direction and speed data of the traveling-direction evaluating unit 52 and the speed evaluating unit 53 are input into the determining unit 223, and the determining unit 223 outputs on the basis of the input values an associated minimum distance value, which is input during a programming phase and can then be compared with the real distance value. The determining unit 223 is likewise configured as a read-write memory. The provision of a minimum distance value that is dependent on the traveling direction and speed by means of the determining unit 223 makes it possible that, when the two cars 12 and 14 are deliberately made to approach each other at very low speed, for example during inspection or servicing travel, no safety gear 72 or 74 is triggered. If, however, the cars 12 and/or 14 have a higher speed, it is ensured by the provision of a correspondingly high minimum distance value that, in the event of an inadmissible approach, a collision can be reliably prevented by triggering of the respective safety gear.

The invention claimed is:

1. Elevator system, comprising:

at least one shaft, at least two cars which can be made to travel along a common traveling path in said at least one shaft, the cars respectively comprising a safety gear, an associated control unit, a drive, and a brake, an electrical safety device, and a shaft information system for determining respective positions and speeds of the cars, said shaft information system being connected to said electrical safety device, wherein:

an emergency stop of a first car is triggerable independently of the control units by means of the safety device if a distance which said first car assumes from a neighboring second car or from an end of the traveling path goes below a preselectable critical distance, and the safety gear of the first car is triggerable to stop the first car if the distance which the first car assumes from the neighboring second car or from the end of the traveling path goes below a preselected minimum distance, said preselected minimum distance being less than said critical distance, the control units of at least all the cars of one traveling path being connected to one another and altogether forming a group control device, and the cars are controlled by the control units in normal operation of the elevator system independently of the safety device while maintaining a safety distance.

2. Elevator system according to claim 1, wherein the preselectable critical distance is dependent on at least one of the speed and traveling direction.

3. Elevator system according to claim 1, wherein the control units of cars disposed on different traveling paths are connected to one another and form a group control device.

4. Elevator system according to claim 1, wherein the control units are connected to the shaft information system, for controlling the respectively associated car while maintaining a speed-dependent distance between the associated car and a neighboring car or the end of the traveling path.

5. Elevator system according to claim 4, wherein, by means of the control units, the drive of the respectively associated car can be switched off and the brake activated.

6. Elevator system according to claim 1, further comprising:

destination input units, disposed outside the cars and connected to the control units, for the input of a travel destination.

7. Elevator system according to claim 6, wherein the destination input units comprise an indicating device for indicating one of said cars to be used.

8. Elevator system according to claim 1, wherein the safety device comprises a number of safety units, each of said safety units being respectively associated with one of said cars.

9. Elevator system according to claim 1, wherein the safety device comprises at least one distance determining unit for determining the distance which one of said cars assumes from a neighboring car or the end of the traveling path, the distance being determinable by means of the respective positions of the cars.

10. Elevator system according to claim 1, further comprising:

distance sensors for determining the distance which the first car assumes from the neighboring second car or the end of the traveling path, the distance sensors being connected to the safety device.

11. Elevator system according to claim 1, wherein the safety device comprises a determining unit for determining the critical distance between the first car and the neighboring second car or the end of the traveling path.

12. Elevator system according to claim 1, wherein the safety device comprises a comparison unit for comparison of a real distance between the first car and the neighboring second car, or the end of the traveling path and the critical distance, and for providing an emergency stop signal if the real distance goes below the critical distance.

13. Elevator system according to claim 1, wherein the cars have an associated speed ascertaining unit for ascertaining the speed of the cars.

14. Elevator system according to claim 1, wherein the shaft information system comprises a marking system, said markinn system being disposed at least one of in the shaft and on the cars, with a multiplicity of markings readable by readers disposed on the cars or in the shaft, the readers being coupled to the safety device.

15. Elevator system according to claim 14, wherein the marking system is disposed within the shaft, and a reader is disposed on each car.

16. Elevator system according to claim 14, wherein the marking system comprises barcode symbols disposed on a carrier, and the readers are configured as barcode readers.

17. Elevator system according to claim 1, wherein the safety gear is mechanically triggerable.

18. Elevator system according to claim 17, wherein each car has an associated element projecting in a direction of a neighboring car, and a stop element for triggering the associated safety gear, at least one projecting element being adapted to act upon the stop element for triggering the safety gear if the distance between two neighboring cars goes below the minimum distance.

19. Elevator system according to claim 18, wherein the safety gear of the first car can be triggered by the projecting element associated with the first car striking against the stop element of the neighboring second car.

20. Elevator system according to claim 18, wherein a distance of the projecting element from the associated car is variable.

21. Elevator system according to claim 18, wherein each car has an associated co-running speed governor cable, which is coupled to the respective safety gear, the projecting element being mounted on the speed governor cable.

22. Elevator system according to claim 18, wherein the stop element can be moved back and forth between a stop position, in which the projecting element of a neighboring car can strike against the stop element, and a release position, in which the projecting element can pass the stop element.

23. Elevator system according to claim 1, wherein the safety gear is triggerable by means of the safety device.

24. Elevator system according to claim 23, wherein the safety device comprises a determining unit for determining a speed-dependent minimum distance.

25. Elevator system according to claim 24, wherein the safety device comprises a comparison unit for comparison of a real distance between the first car and the neighboring second car or the end of the traveling path with the minimum distance, and for providing a safety gear trigger signal if the real distance goes below the minimum distance.

* * * * *

UNITED STATES PATENT AND TRADEMARK OFFICE

CERTIFICATE OF CORRECTION

PATENT NO. : 7,353,912 B2
APPLICATION NO. : 11/124616
DATED : April 8, 2008
INVENTOR(S) : Reuter et al.

It is certified that error appears in the above-identified patent and that said Letters Patent is hereby corrected as shown below:

Column 14, line 14 - at the beginning of the line, “markinn” is corrected to read -- marking --.

Signed and Sealed this

Eighth Day of July, 2008

JON W. DUDAS
*Director of the United States Patent and Trademark Office*